US005494179A

United States Patent [19]

Hori et al.

[11] Patent Number: 5,494,179

[45] Date of Patent: Feb. 27, 1996

[54] FIELD-EMITTER HAVING A SHARP APEX AND SMALL-APERTURED GATE AND METHOD FOR FABRICATING EMITTER

[75] Inventors: Yoshikazu Hori, Kobe; Keisuke Koga, Uji, both of Japan

[73] Assignee: Matsushita Electric Industrial Co., Ltd., Osaka, Japan

[21] Appl. No.: 275,354

[22] Filed: Jul. 15, 1994

[30] Foreign Application Priority Data

| | | | |
|---|---|---|---|
| Jul. 16, 1993 | [JP] | Japan | 5-176450 |
| Oct. 22, 1993 | [JP] | Japan | 5-264584 |
| Apr. 28, 1994 | [JP] | Japan | 6-091397 |

[51] Int. Cl.[6] ..... B44C 1/22

[52] U.S. Cl. ..... 216/11; 216/41; 216/56; 156/647.1; 156/649.1; 156/651.1; 156/644.1; 156/657.1

[58] Field of Search ..... 156/647.1, 649.1, 156/651.1, 661.1, 644.1, 657.1; 216/11, 41, 56

[56] References Cited

U.S. PATENT DOCUMENTS

| | | | |
|---|---|---|---|
| 4,572,765 | 2/1986 | Berry | 156/657.1 X |
| 4,943,343 | 7/1990 | Bardai et al. | 156/644.1 X |

OTHER PUBLICATIONS

Betsui, Keiichi, "Fabrication and Operation of Silicon Micro–Field–Emitter–Array," Electro Information Communication Society: Fall 1990 Meeting.

Gray, H. F., "Silicon Field Emitter Array Technology," Proc. Intern. R–Field Emission Symposium, pp. 111–119 (1982).

Spindt, C. A. et al., "Physical properties of thin–film field emission cathodes with molybdenum cones," pp. 5248–5263, Journal of Applied Physics, vol. 27, No. 12, Dec. 1976.

*Primary Examiner*—William Powell

*Attorney, Agent, or Firm*—Willian Brinks Hofer Gilson & Lione

[57] ABSTRACT

The invention is a field-emission element having a cathode with a sharp apex and a gate with an aperture diameter less than 1 μm that is fabricated by covering a silicon substrate with a silicon oxide layer, forming an etching mask of 1.0 μm diameter from a silicon oxide layer by photolithography, wet-etching the etching mask to form a minute etching mask of less diameter, dry etching the substrate to form a cylindrical solid structure, followed by anisotropic etching to form a couple of minute conical-shaped structures facing each other and connected by their respective tops, vacuum evaporating around the minute structures an insulating layer and thereon a conducting layer for use as a gate electrode, and etching the minute structure to lift off the upper part of the minute conical shaped structures.

26 Claims, 15 Drawing Sheets

FIG. 1(a)
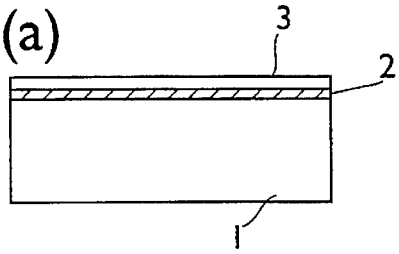
FIG. 1(b)
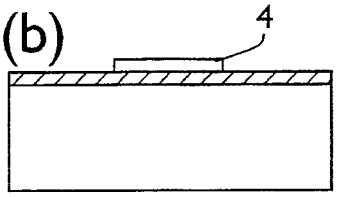
FIG. 1(c)
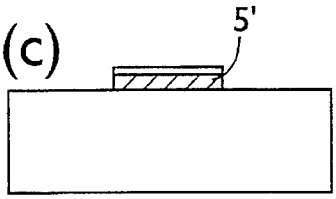
FIG. 1(d)
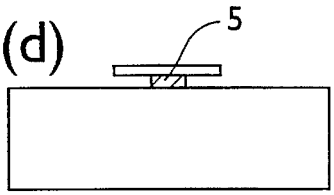
FIG. 1(e)
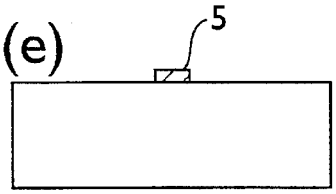
FIG. 1(f)
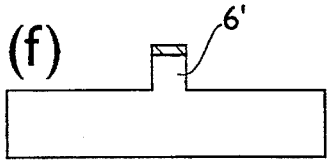
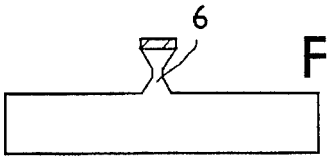
FIG. 1(g)
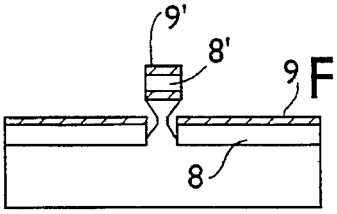
FIG. 1(h)
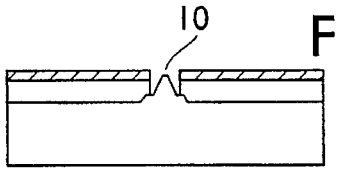
FIG. 1(i)

FIG. 2 (a)
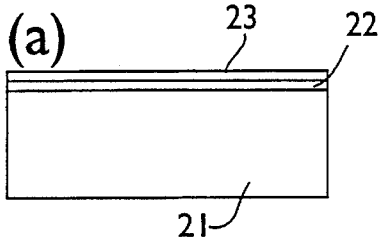
FIG. 2 (b)
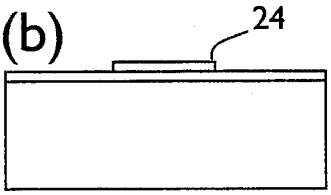
FIG. 2 (c)
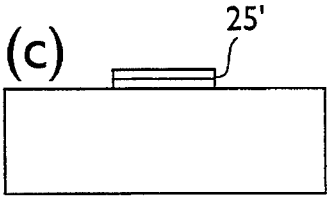
FIG. 2 (d)
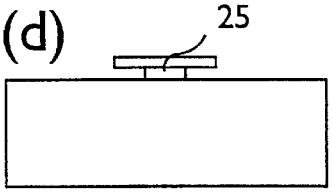
FIG. 2 (e)
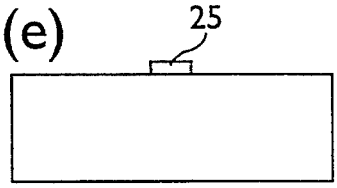
FIG. 2 (f)
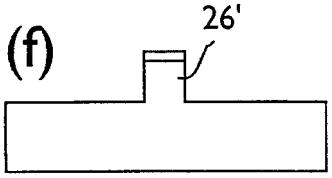
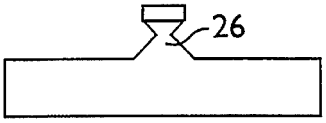
FIG. 2 (g)
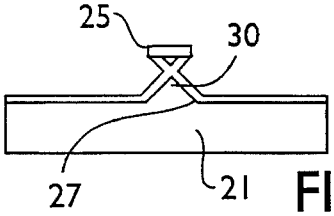
FIG. 2 (h)
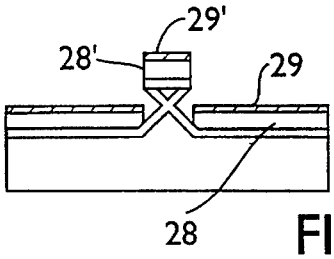
FIG. 2 (i)
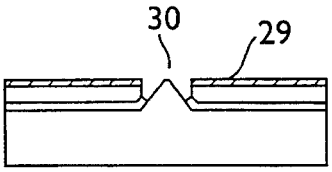
FIG. 2 (j)

FIG. 3(a)
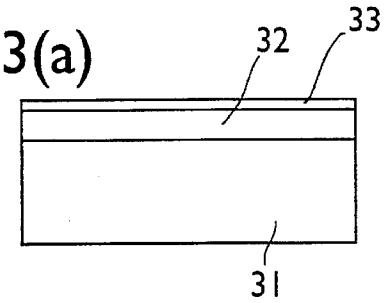
FIG. 3(b)
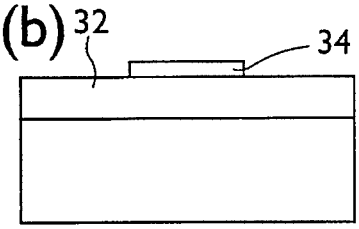
FIG. 3(c)
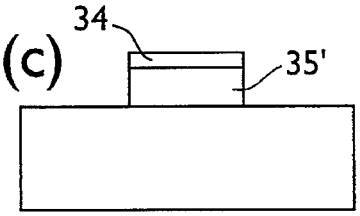
FIG. 3(d)
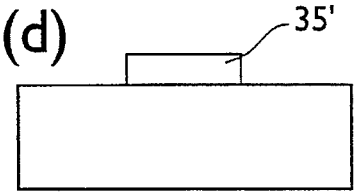
FIG. 3(e)
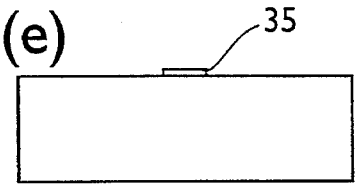
FIG. 3(f)
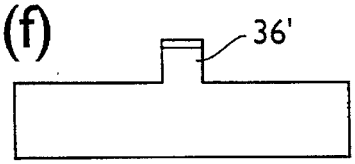
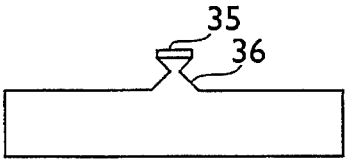
FIG. 3(g)
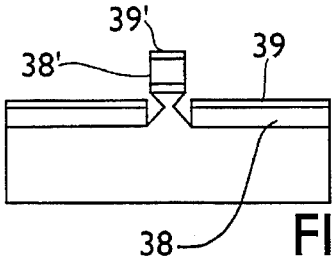
FIG. 3(h)
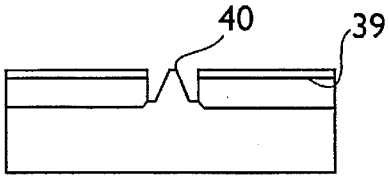
FIG. 3(i)

FIG. 4(a)
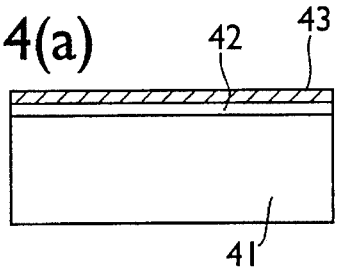
FIG. 4(b)
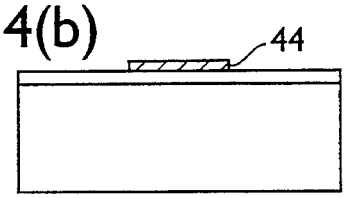
FIG. 4(c)
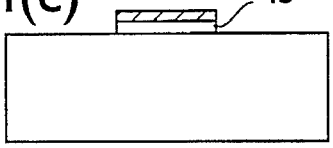
FIG. 4(d)
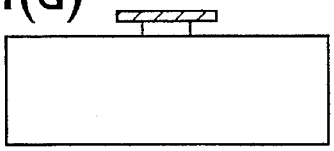
FIG. 4(e)
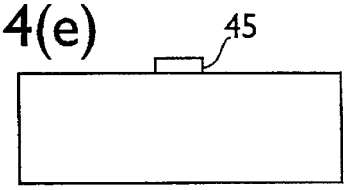
FIG. 4(f)
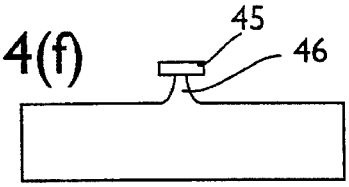
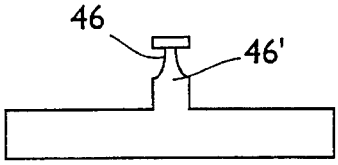
FIG. 4(g)
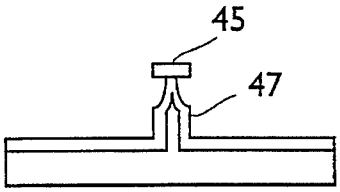
FIG. 4(h)
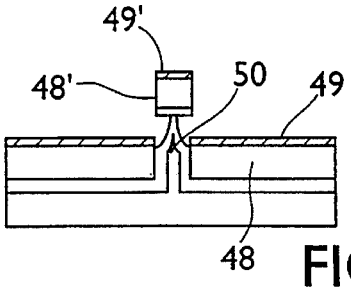
FIG. 4(i)
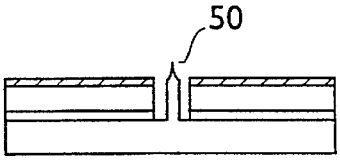
FIG. 4(j)

FIG.6 (a)
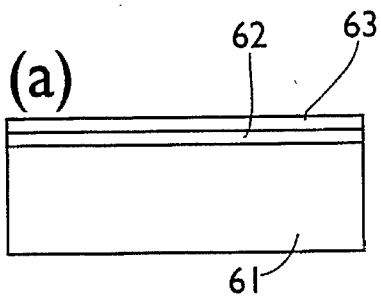
FIG.6 (b)
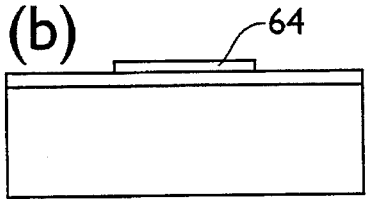
FIG.6 (c)
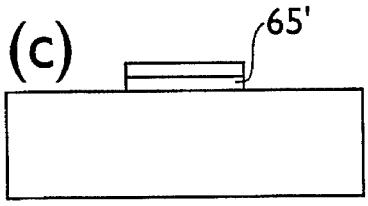
FIG.6 (d)
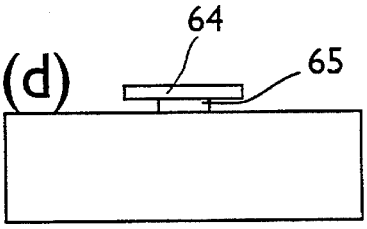
FIG.6 (e)
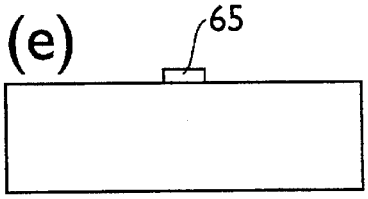
FIG.6 (f)
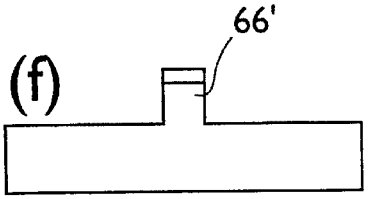
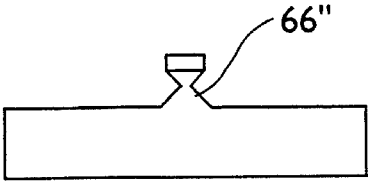
FIG.6 (g)
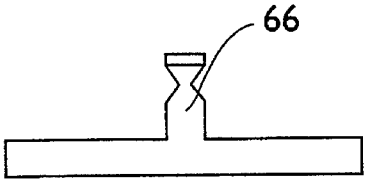
FIG.6 (h)
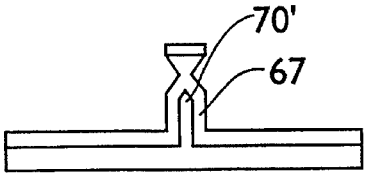
FIG.6 (i)
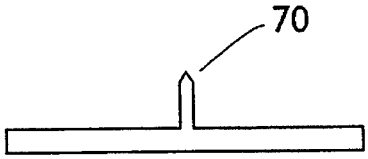
FIG.6 (j)

FIG. 7(a)
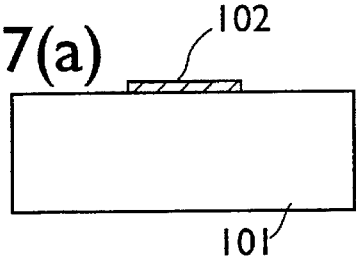
FIG. 7(b)
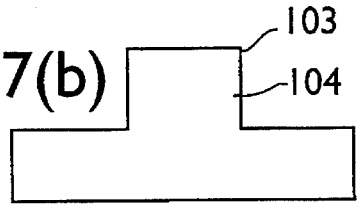
FIG. 7(c)
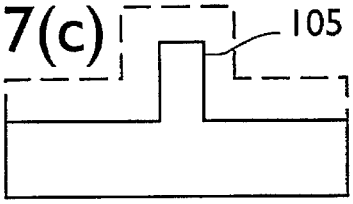
FIG. 7(d)-1
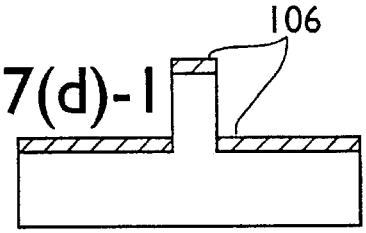
FIG. 7(e)
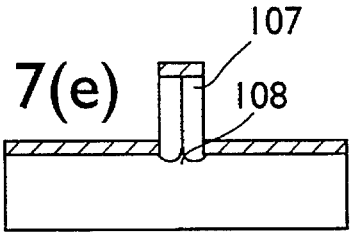
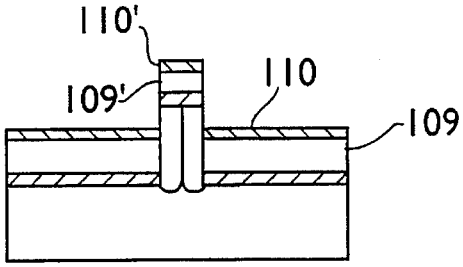
FIG. 7(f)
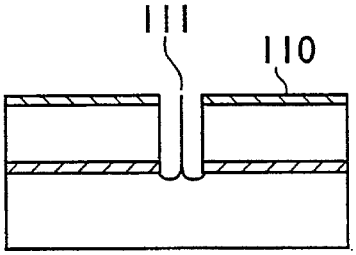
FIG. 7(g)
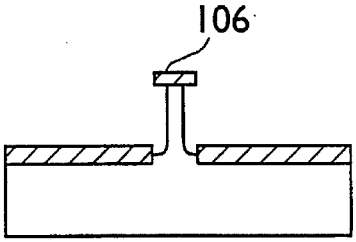
FIG. 7(d)-2

FIG. 8(a)
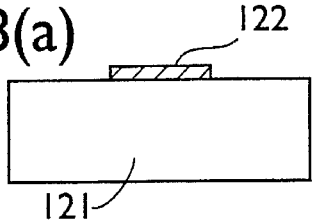
FIG. 8(b)
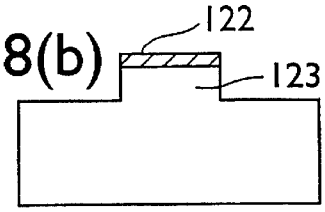
FIG. 8(c)
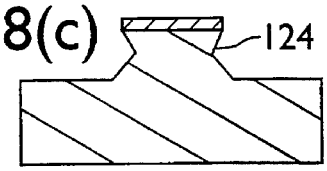
FIG. 8(d)
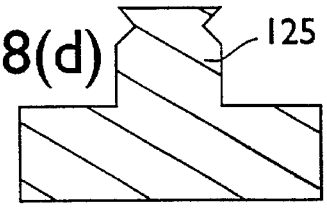
FIG. 8(e)
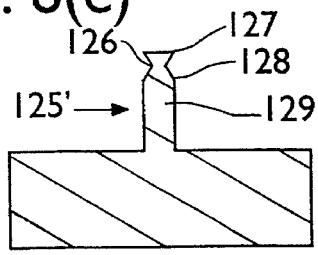
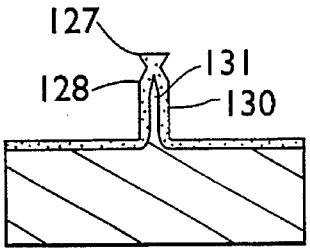
FIG. 8(f)
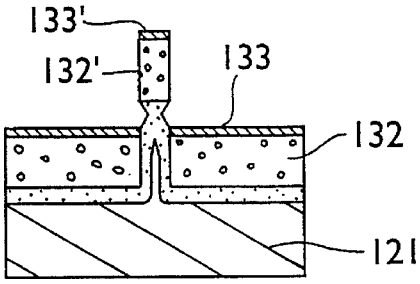
FIG. 8(g)
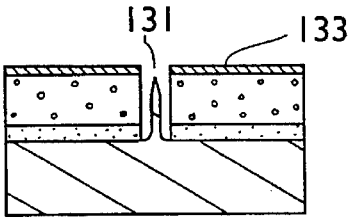
FIG. 8(h)

FIG. 9(a)
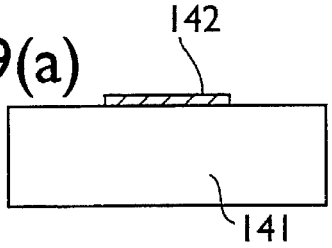
FIG. 9(b)
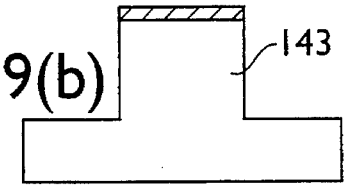
FIG. 9(c)
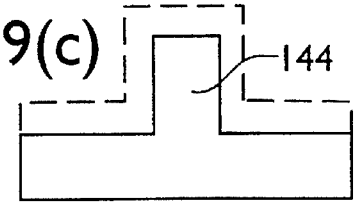
FIG. 9(d)
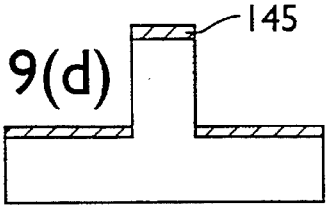
FIG. 9(e)
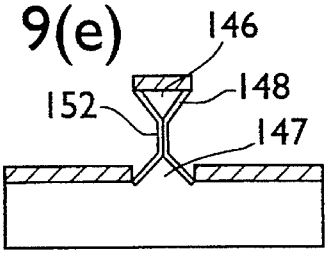
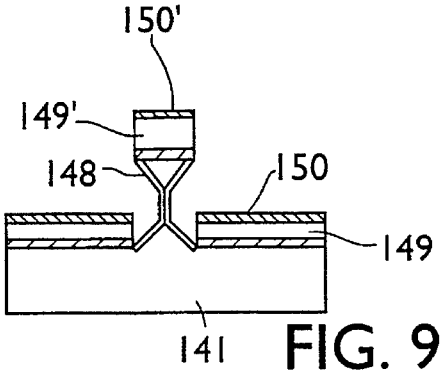
FIG. 9(f)
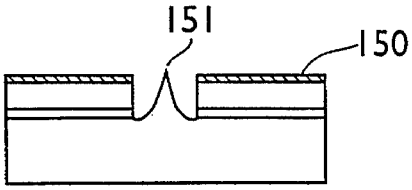
FIG. 9(g)

FIELD-EMITTER HAVING A SHARP APEX AND SMALL-APERTURED GATE AND METHOD FOR FABRICATING EMITTER

BACKGROUND OF THE INVENTION

The present invention relates to minute field-emission elements, which are capable of integration and operable at a low voltage. The present invention relates also to the methods of fabricating the minute field-emission elements.

This application is related to patent application Ser. No. 08/269,676 filed Jul. 1, 1994, by the same inventor as an inventor of the present invention.

At the outset, it is to be noted that the following description and the claims use "( )" to describe a crystal plane and "<>" to describe a crystal direction. Such usages are well known in crystallography.

The fabrication of miniaturized field-emission elements became possible by the advancements of semiconductor fabrication technologies. In particular, Spindt et al. disclosed the fabrication of a cone-shaped field-emission cathode. (C. A. Spindt, J. Appl. Phys, Vol. 47, p. 5248 (1976).

The conventional method of fabricating a field-emission cathode disclosed by Spindt et al. is shown in FIGS. 13(*a*)–13(*d*) and is explained below.

As shown in FIG. 13(*a*), the fabrication process is begun with depositions of an insulation layer 402 and a metal layer 403 utilized as a gate electrode on a conductive substrate (silicon) 401. A round small hole 404 is then formed in said metal layer 403 and insulation layer 402 by using a conventional photolithographic process. Next, as shown in FIG. 13(*b*), a sacrificing layer 405, made of a material such as alumina, is vacuum deposited on the substrate 401 at a shallow angle thereto and the gate electrode. As a result, the diameter of gate aperture 404 is substantially reduced. Then, as shown in FIG. 13(*c*), the metal layer 406, made of a material such as molybdenum, is deposited perpendicularly to the substrate 401. The gate-aperture diameter is gradually reduced as the metal layer 406 is vacuum deposited, and a cone-shaped emitter (cathode) 407 is formed within gate aperture 404 since the gate-aperture becomes smaller as the deposition proceeds.

Lastly, as shown in FIG. 13(*d*), the fabrication process is completed by removing the sacrificing layer 405 and the unnecessary metal layer 406 using an etching or lift-off method. The field-emission cathode 407, thus obtained, is operable by applying a high-voltage on gate electrode 403. This causes electrons to be drawn into a vacuum from the cathode 407. The electrons are collected by an anode (not shown) disposed at a position opposing the cathode 407.

Another process for fabricating a cone-shaped field-emission cathode was disclosed by Gray et al. (H. F. Gray et al., IEDM Tech. Dig. P. 776 (1980)). The conventional method of fabricating a field-emission cathode, using a silicon substrate and anisotropic etching, is shown in FIGS. 14(*a*)–14(*e*) and is explained below.

As shown in FIG. 14(*a*), the fabrication process is begun with the deposition of a silicon oxide film 412 on the (100) plane surface of a conductive (silicon) substrate 411. Then, as shown in FIG. 14(*b*), a photolithographic process is applied to the film 412 to form a circular mask 413. Next, as shown in FIG. 14(*c*), part of the silicon substrate under the mask 413 is formed into a cone 414 having a sharp top 417 (FIG. 14(*e*)), by using anisotropic etching to slowly etch the (111) crystal plane in a slanted relationship with the (100) plane surface of the silicon substrate 411. Next, as shown in FIG. 14(*d*), an insulating layer 415 and a metal layer forming a gate electrode 416 are deposited around the cone 414. The circular mask 413 prevents the insulating layer 415 and the gate electrode 416 from forming on the side or slanted surface of the cone 414. Lastly, as shown in FIG. 14(*e*), the mask 413 and the insulating and metal layers thereon, are removed, resulting in a field-emission cathode 417 having a cone shape.

It is possible to fabricate a field-emission cathode having a sharper top than the cone-shaped cathodes disclosed by Spindt et al. and Gray et al. Betui discloses a process for fabricating a field-emission cathode using a combination of dry etching silicon and thermal oxidation. (K. Betui, Tech. Digest IVMC '91, 26 (Nagnhama 1991)). The conventional method of fabricating a field-emission cathode, as disclosed by Betui, is shown in FIGS. 15(*a*)–15(*e*) and is explained below.

As shown in FIG. 15(*a*), the fabrication process is begun by forming a silicon oxide film 432 on a silicon substrate 431. Next, as shown in FIG. 15(*b*), a photolithographic process is applied to the silicon oxide film 432 to form a circular mask 433. Next, as shown in FIG. 15(*c*), dry etching with appropriate conditions is used to form a protrusion 434 of a cylindrical shape under the mask 433. Then, thermal oxidation is applied to form a silicon oxide film 435 leaving the protrusion 434 with a sharp apex 436. Next, as shown in FIG. 15(*d*), an insulating film 437 and a metal film 438, to be used as a gate, are deposited around the cathode 436. Lastly, as shown in FIG. 15(*e*), the mask 433 and the insulating and metal films thereon are removed, resulting in a field-emission cathode 436 having a sharp apex.

It should be noted that albeit, the conventional processes described above refer to cone-shaped cathodes, the processes can also be used to fabricate cathodes having a pyramid form.

In forming the cone-shaped cathodes described above, it is preferable that the diameter of the hole of the gate electrode be as small as possible, as the size of the hole affects the operable voltage and current density characteristics of a field-emission type electron source. Under the processes described above using a conventional photolithographic process, the smallest hole obtainable is about 1 μm. Smaller holes are possible using electron beams or x-ray lithography. However, such processes are expensive to operate and do not fabricate elements with uniform characteristics.

None of the conventional methods described above disclosed fabricating a tower type field-emission cathode. A tower type cathode, rather than a cone-shaped cathode, produces a stronger electric field and can be operable at lower voltages. However, none of the known field-emission element fabrication processes are capable of re-producing such a field-emission element. The known fabrication processes are not capable of producing field-emission electron sources operable at low working voltages with good reproducibility.

SUMMARY OF THE INVENTION

According to the invention, a field emitter can be fabricated that includes a cathode with a sharp apex surrounded by a gate electrode having a very small aperture. The fabrication process provides good reproducibility and results in fabricating field-emission electron sources operable at low voltages.

Fabrication of the field emitter involves first forming a minute etching mask. According to the invention, a minute etching mask is formed by patterning a covering layer formed on a conductive substrate, or a conductive layer deposited on a substrate, with an etching mask prepared by lithographic technology; and etching the covering layer to form a minute etching mask that is smaller in cross-section than the etching mask above it. When etching the covering layer, the etching mask can remain in place or be removed. The etching process can form a minute etching mask smaller than 1 μm, which is smaller than the etching masks formed with conventional fabrication methods to fabricate the apertures of gate electrodes in field-emission elements.

Different methods using the minute etching mask, and others using a protective layer as a mask, are disclosed for fabricating a field-emission element.

According to one method, etching is applied to the surface of a conduction substrate or conduction layer on a substrate, with said minute etching mask thereon. The part of the surface not protected by the minute mask is etched to form a pillar-shaped structure. Then the side surface of the pillar-shaped structure is etched to form a minute structure having a part smaller than the original cross-section of the pillar-shaped structure. In this manner a minute structure is formed from the substrate or conduction layer. Thereafter, an insulation layer is deposited, and then a conduction layer, around the minute structure and the minute etching mask on top of the minute structure. Lastly, the side surface of the minute structure is etched further to reduce the cross-section of the thinned part to remove the minute etching mask, the portion of the minute structure under the minute etching mask and the insulation and conductive layer deposited on the minute etching mask. These steps are used to form a field emitter comprising a conductive element with a shape apex formed by the lower portion of the minute structure and a gate electrode having a small aperture formed by the conductor layer deposited on the surface of the substrate or conductive layer. The field-emission element, thus fabricated, is highly advantageous in that it has a gate electrode with an aperture smaller than gate electrodes formed by conventional methods thereby, resulting in an electron source operable with a small working voltage, and providing large current density.

According to another fabrication method, part of the conductive substrate or conductive layer not covered by a circular etching mask is etched to form a cylindrical pillar-shaped structure which is perpendicular to the conductive material. Then, etching is applied to the upper and side surfaces of said cylindrical structure to form a minute cylindrical structure having a diameter less than 1 μm, which is smaller than said cylindrical structure.

Next, a protection layer is deposited on the upper surface of said minute cylindrical structure and the conductive material. The side surface of the minute cylindrical structure is then etched or thermally treated to form, under the protection layer, a minute cathode with a sharp apex. Thereafter, a metal layer is deposited around the minute cathode to be used as the gate, using the protection layer as a mask.

Lastly, the protection layer and the metal layer deposited over the minute cathode are removed to expose the minute cathode, thus obtaining a field emitter capable of working at low voltages since the resulting gate electrode has an aperture with a diameter of less than 1 μm.

A further fabrication method according to the present invention is as follows. A silicon substrate is provided with an etching mask on the (100) plane surface thereof, and is etched for form a pillar-shaped structure having its the side perpendicular to the flat substrate surface. Then, the side of the pillar-shaped structure is anisotropically etched to expose the surfaces of the (111) plane, which is slanted from the substrate surface thereby, producing a conical structure having an upper structure of reversed conical form facing a lower structure of conical form connected by the tops of the cones.

Next, the surface of said conical structure is thermally oxidized to separate the upper and lower conical structures with an oxide layer and to produce, in the neighborhood of the connecting part, a lower structure with a sharp apex.

Further, using the upper conical structure as a mask, an insulating layer and a metal layer, which will become the gate electrode, are deposited on the substrate surface and the upper conical structure.

Lastly, the oxide layer near the connecting part is etched and the upper structure with the insulation and metal layers thereon are removed, to produce a field-emission cathode with a sharp apex and capable of low voltage operation.

According to the present invention, a pillar-shaped structure can be fabricated, using a minute etching mask having a cross-section smaller than an etching mask. By perpendicularly etching a substrate to form a smaller pillar-shaped structure, and, thereafter, etching the side of the smaller pillar-shaped structure, it is possible to fabricate a field-emission cathode in the shape of a tower with a sharp apex and surrounded by a gate electrode with an aperture that is made smaller than apertures made by conventional methods.

Thus, the hereinafter methods describe various processes for fabricating a field-emission element having the advantage of having a gate electrode, around a cathode with a sharp apex, with an aperture far less than the 1 μm diameter obtained by conventional photolithography processes, to provide a field electron source having the excellent characteristic of being operable at low voltages to produce high current densities.

BRIEF DESCRIPTION OF THE DRAWINGS

FIGS. 1(*a*), 1(*b*), 1(*c*), 1(*d*), 1(*e*), 1(*f*), 1(*g*), 1(*h*) and 1(*i*) are sectional views of a field emission element fabricated according to the first embodiment of the invention by anisotropically etching a pillar formed by a minute etching mask.

FIGS. 2(*a*), 2(*b*), 2(*c*), 2(*d*), 2(*e*), 2(*f*), 2(*g*), 2(*h*), 2(*i*) and 2(*f*) are sectional views of a field emission element fabricated according to the second embodiment of the invention applying thermal oxidation to a pillar formed by a minute etching mask and anisotropically etched.

FIGS. 3(*a*), 3(*b*), 3(*c*), 3(*d*), 3(*e*), 3(*f*), 3(*g*), 3(*h*) and 3(*i*) are sectional views of a field emission element fabricated according to the third embodiment of the invention including an alternate manner of forming a minute etching mask.

FIGS. 4(*a*), 4(*b*), 4(*c*), 4(*d*), 4(*e*), 4(*f*), 4(*g*), 4(*h*), 4(*i*) and 4(*j*) are sectional views of a field emission element fabricated according to the fourth embodiment of the invention applying thermal oxidation to a pillar formed by a minute etching mask and dry-etched.

FIGS. 6(*a*), 6(*b*), 6(*c*), 6(*d*), 6(*e*), 6(*f*), 6(*g*), 6(*h*), 6(*i*) and 6(*j*) are sectional views of a field emission element fabricated according to the sixth embodiment of the invention by dry-etching an anisotropically-etched structure and further applying thermal oxidation.

FIGS. 7(*a*), 7(*b*), 7(*c*), 7(*d*)-1, 7(*i d*)-2, 7(*e*), 7(*f*) and 7(*g*) are sectional views of a field emission element fabricated according to the seventh embodiment of the invention applying thermal oxidation to an isotropically-etched structure.

FIGS. 8(*a*), 8(*b*), 8(*c*), 8(*d*), 8(*e*), 8(*f*), 8(*g*) and 8(*h*) are sectional views of a field emission element fabricated according to the eighth embodiment of the invention applying thermal oxidation to an anisotropically-etched and isotropically-etched structure.

FIGS. 9(*a*), 9(*b*), 9(*c*), 9(*d*), 9(*e*), 9(*f*) and 9(*g*) are sectional views of a field emission element fabricated according to the ninth embodiment of the invention applying thermal oxidation to an isotropically-etched and anisotropically-etched structure.

DETAILED DESCRIPTION

First Embodiment

Figure 5A:
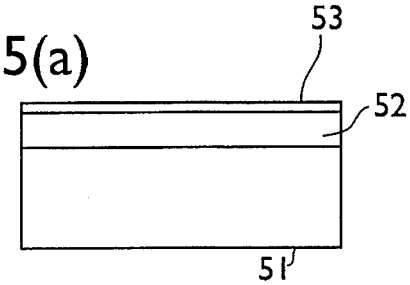
FIGS. 5(*a*), 5(*b*), 5(*c*), 5(*d*), 5(*e*), 5(*f*), 5(*g*), 5(*h*), 5(*i*), 5(*j*), 5(*k*) and 5(*l*) are sectional views of a field emission element fabricated according to the fifth embodiment of the invention by dry-etching a thermally oxidized structure and further applying thermal oxidation.

As shown in FIG. 1(*a*), a silicon oxide or dielectric layer 2 is formed on the (100) surface of a silicon substrate 1 by thermal oxidation and covered by a photoresist layer 3.

Next, as shown in FIG. 1(*b*), photolithography is applied to the photoresist layer 3 to form a circular etching mask 4 of about 1 μm diameter.

Next, as shown in FIG. 1(*c*), the oxide layer 2 around the mask 4 is removed by dry etching the oxide layer 2 around the mask to form a disc 5' of oxide having a similar diameter as the mask 4.

Next, as shown in FIG. 1(*d*), the disc 5' is dry etched to reduce the diameter of the disc 5' to about 0.3 μm diameter.

Next, as shown in FIG. 1(*e*), the etching mask 4 is removed. The silicon substrate is left with a minute etching mask 5 of silicon oxide and of about 0.3 μm diameter. The steps shown in FIGS. 1(*a*)–1(*e*) are herein identified as forming a minute etching mask forming process.

Next, as shown in FIG. 1(*f*), dry etching is applied to the silicon substrate 1 in such a manner so as to prevent the side etching of the portion of the substrate 1 under the minute mask 5. High-speed chlorine gas or sulfur-fluoride gas is used to form a cylindrical structure 6'. The steps shown in FIGS. 1(*a*)–1(*f*) are herein identified as forming a pillar-shaped structure forming process.

Next, as shown in FIG. 1(*g*), anisotropic etching is applied to the cylindrical structure 6', using a KOH solution or a ethylenediamine solution, to form a minute structure 6 comprising a pair of cone-shaped structures joined at their respective tops with the sides of each cone including the (111) plane. The anisotropic etching is applied until the diameter of the most slender part of the minute structure 6 is about 0.1 μm.

Next, as shown in FIG. 1(*h*), an insulation layer, followed by a metal layer such as aluminum, are deposited by vacuum evaporation to form an insulating layer 8, 8' and a metal layer 9, 9' on the substrate 1 and mask 5.

Next, as shown in FIG. 1(*i*), wet etching is applied to the most slender portion of the minute structure 6 to reduce its diameter and remove the upper portion of the structure 6. As a result, the inverted cone portion of the minute structure 6 is removed together with the minute etching mask 5 and the insulating layer 8' and metal layer 9'. The resulting structure is cathode 10 having a sharp apex and a gate electrode 9, formed from the metal layer 9, having a minute inside diameter that is the same as the minute etching mask 5.

Important advantages are achieved with the fabrication process described above under the First Embodiment. The process just described produces a field-emission element that has a gate electrode with a much smaller diameter than was possible under the conventional fabrication processes. This results in a cathode that operates under a very low voltage.

As described above, photolithography is used to form a circular etching mask 4 on a silicon oxide layer 5'. The diameter of the oxide layer 5 is reduced by etching its border. Then, the etching mask 4 is removed, and the remaining oxide layer is used as a minute etching mask to form a gate electrode 9 having a minute gate diameter, which is smaller than the minimum value obtained by photolithography. The field-emitting cathode resulting from this process is operable under very low voltage.

Variations to the embodiment described above are possible. For example, instead of the etching mask of the circular shape described above, masks of the other various shapes or cross-sections, such as polygonal, or in the shape of a dot with a certain diameter or a line with a certain width arranged in the <011> direction, can be made if necessary. If a linear etching mask with a certain width is necessary, a linear etching mask, arranged in the <011> direction, produces neat anisotropic etching with good reproducibility. In addition, the solubility of the photoresist material is variable by light exposition. Further, the etching mask is not soluble in the solution that dissolves the covering layer.

Further, instead of using the (100) surface of the substrate 1 as the cathode material and anisotropic etching to get sharp apex thereof described above in the First Embodiment, the side of the silicon substrate can be dry-etched to produce a cone type structure under the etching mask, provided the etching is made under a condition to produce side etching.

The material for the substrate is not confined to silicon, but tungsten or molybdenum can be used also. The etching mask could be formed by vacuum evaporation when using tungsten or molybdenum. Further, instead of using a conductive substrate such as silicon, a conductive layer such as silicon, formed on a substrate such as glass, may also be used.

Second Embodiment

The steps shown in FIGS. 2(*a*)–2(*g*) are the same steps shown in FIGS. 1(*a*)–1(*g*) and described under the First Embodiment. Hence, the structure 26 in FIG. 2(*g*) is fabricated similarly to the structure 6 in FIG. 1(*g*).

The elements shown in FIGS. 2(*a*)–2(*g*) are as follows: a silicon substrate 21, a silicon oxide 22, a photoresist layer 23, an etching mask 24, a disc structure 25', a minute etching mask 25 and a cylindrical solid structure 26'.

Next, as shown in FIG. 2(*h*), thermal oxidation is applied to form a silicon oxide layer 27 on the silicon substrate 21 and on the surface of the minute structure 26. A silicon cathode structure 30 having a sharp apex is formed inside the silicon oxide layer 27. Next, as shown in FIG. 2(*i*), an insulating film 28, 28' and then a metal film 29, 29' are vacuum deposited on the surface of the silicon oxide layer 27 covering the surface of the substrate 21 and the minute etching mask 25. Next, as shown in FIG. 2(*j*), wet etching is applied to the side of the minute structure 26 to remove the portion of the oxide layer 27 around the cathode 30, the minute etching mask 25 with the insulating film 28' and the metal 29' thereon, and the small reversed or inverted cone portion of the minute structure 26 under the minute mask 25.

The process described under the Second Embodiment produces a field-emission element having a cathode 30 with a very sharp apex and a gate 29, formed by the metal film 29, with a small aperture. The advantage of this process is the use of thermal oxidation to produce a cathode with a very sharp apex.

Variations on the process described under the Second Embodiment similar to those described under the First Embodiment are also possible. For example, instead of anisotropic etching, the (100) surface of the silicon substrate 21 and the same field-emission element can be obtained by side-etching the substrate with a dry etching process.

Third Embodiment

The steps shown in FIGS. 3(*a*)–3(*c*) are the same steps shown in FIGS. 1(*a*)–1(*c*). Specifically, a surface of a silicon substrate 31 is oxidized to form a silicon oxide layer 32, most of which is etched away leaving a disc structure 35' with an etching mask 34 thereon; the etching mask 34 being made by patterning the photoresist layer 33.

Next, as shown in FIG. 3(*d*), the etching mask 34 is removed to expose the disc structure 35'. Next, as shown in FIG. 3(*e*), wet etching is applied to reduce the disc structure 35' to a minute circular etching mask 35 having a very small diameter of about 0.3 μm. The steps shown in FIGS. 3(*a*)–3(*e*) provide an alternate process, from that shown in FIGS. 1(*a*)–1(*e*), for forming a minute etching mask.

Next, the steps shown in FIGS. 3(*f*)–3(*i*) are the same as the steps shown in FIGS. 1(*f*)–1(*i*) and described under the First Embodiment. In particular, dry etching is applied to produce a cylindrical structure 36', which is then side etched leaving a minute structure 36 consisting of two cones facing each other. By depositing an insulator layer 38, 38' and after, a metal layer 39, 39' on the substrate 31 and then, etching to remove the upper half of the minute structure 36 to remove the metal 39', insulating layer 38', mask 35 and the inverted cone, a field-emission cathode having a sharp apex 40 and gate 39 with a small hole is obtained.

The process described under the Third Embodiment is very similar to the process described under the First Embodiment. However, under the Third Embodiment, the advantage in forming a minute etching mask 35 by reducing the disc structure 35' is using wet etching after the etching mask 34 has been removed. The minute etching mask 35 is then used to form a field-emission element having a gate electrode with an aperture smaller than that obtained by conventional photolithography, and a field-emission cathode operable with low voltages.

Fourth Embodiment

The steps shown in FIGS. 4(*a*)–4(*e*) are the same steps shown in FIGS. 1(*a*)–1(*e*) and described under the First Embodiment. In particular, a minute etching mask 45 is formed beginning with a silicon substrate 41 covered with an oxide layer 42 and a photoresist layer 43. The oxide layer 42 is then etched off, except for the part under mask 44 formed from the photoresist layer 43. The portion of the oxide layer 45' under the mask 44 is further etched off to form the minute mask 45.

Next, as shown in FIG. 4(*f*), dry etching is applied under such a condition as to produce side-etching using, for example, chlorine gas or sulfur fluoride gas, to form, under the mask 45, a first structure 46 in the shape of a cone, having a diameter smaller than that of the etching mask 45. The smallest diameter is about 0.1 μm.

Then, as shown in FIG. 4(*g*), dry etching is applied under the condition as to produce no side-etching using, for example, high-speed chlorine gas or sulfur fluoride gas, to form a second structure 46' in the shape of a cylinder under the first cone-shaped structure 46, the diameter of the cylinder being nearly the same as that of the minute etching mask 45.

Next, as shown in FIG. 4(*h*), by thermal oxidation, the surface of the first and second structures 46, 46' is changed to an oxide layer 47, and at the same time a cathode 50 with a small diameter and a sharp apex is formed within the first and second structures 46, 46'.

Next, as shown in FIG. 4(*i*), by vacuum deposition, an insulation layer 48, 48' and then a conducting layer 49, 49' are deposited on the oxide layer 47, the emitter or cathode 50 being left uncovered.

Next, as shown in FIG. 4(*j*), wet etching is applied to the side surface of the structures 46, 46' to remove the oxide layer 47 thereon, and the minute etching mask 45, together with the insulating 48' and conducting layers 48'. The conducting layer 49 becomes a gate electrode with a very small aperture.

Thus, a field-emitting cathode having a cathode 50 with sharp apex and the gate electrode 49, having an aperture of the same diameter as the minute etching mask and operable at low voltages is fabricated with the method described under the Fourth Embodiment. This process is highly advantageous in that it is possible to fabricate the cathode (emitter) with diameter less than 100 nm and a radius of curvature less than 10 nm at the top.

Fifth Embodiment

Figure 5B:
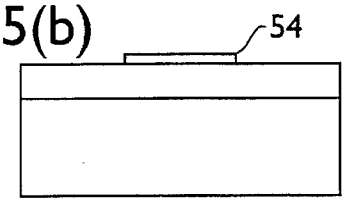
Figure 5C:
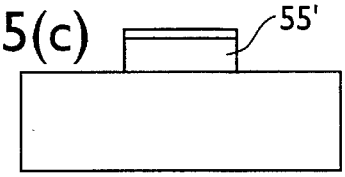
Figure 5D:
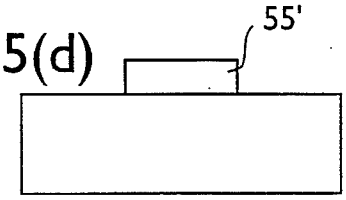
Figure 5E:
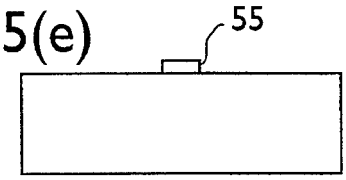
Figure 5F:
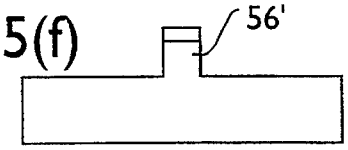
Figure 5G:
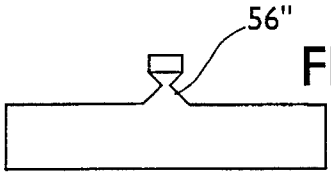
Figure 5H:
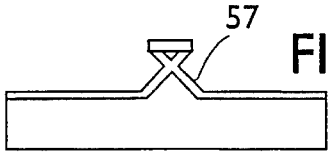
Figure 5I:
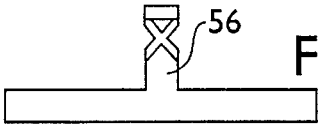
Figure 5J:
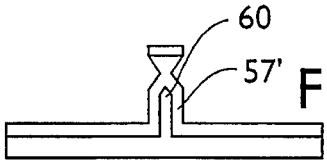
Figure 5K:
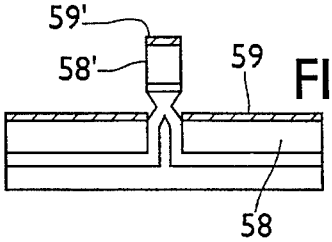
Figure 5L:
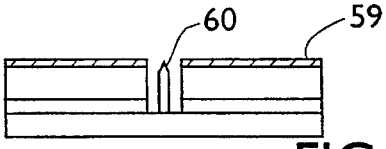

The steps shown in FIGS. 5(*a*)–5(*h*) are the same steps shown in FIGS. 2(*a*)–2(*h*) and described under the Second Embodiment except that the minute etching mask 55 is prepared in the manner shown under the Third Embodiment. In particular, the structure shown in FIG. 5(*h*) is a structure consisting of a silicon substrate 51 and, on a surface thereof, a first minute structure of two cones 56" as shown in FIG. 5(*g*), covered with a silicon oxide layer 57. This structure is prepared by starting with a silicon substrate 51 covered with an oxide layer 52, having a photoresist layer 53 thereon. An etching mask 54 is patterned from the layer 53. A disc structure 55' is formed from the oxide layer 52 under the mask 54. A minute etching mask 55 is obtained by etching the disc structure 55' with the etching mask 54 removed. A cylindrical structure 56' is formed under the minute etching mask 55 by etching the substrate 51.

Next, as shown in FIG. 5(*i*), dry etching is applied, under the condition as not to produce side etching, to the flat surface of the substrate 51 to form a second minute structure 56 under the conical structure 56". The diameter of the second solid structure 56 is nearly the same as that of the minute etching mask 55.

Next, as shown in FIG. 5(*j*), by thermal oxidation, the surfaces of the cylindrical second minute structure 56 and the conical structure 56" are changed to a silicon oxide layer 57'. Inside the second structure 56, an emitter or cathode 60 in the form of a tower is formed, having a small diameter and a sharp apex.

Next, as shown in FIG. 5(*k*) by vacuum deposition, the horizontal part of the oxide layer 57', as well as the top of the minute etching mask 55 are first covered with a thick silicon oxide layer 58, 58' and then, with a conducting layer 59, 59'.

Next, as shown in FIG. 5(1), wet etching is applied to the side of the first minute structure 56" and the second minute structure 56, to remove the oxide layers thereon and the minute etching mask 55, together with the oxide layer 58', and the conducting layer 59'.

The fabrication process described under the Fifth Embodiment produces a field-emitting cathode in the shape of a tower with a small diameter and sharp apex, and having a gate with minute aperture of the same diameter as the minute etching mask. This process is highly advantageous because the steps of forming shape and height of the first minute structure and the second minute structure can be reproduced with good results.

Sixth Embodiment

The steps shown in FIGS. 6(*a*)–6(*g*) are the same steps shown in FIGS. 1(*a*)–1(*g*) and described under the First Embodiment. In particular, the structure shown in FIG. 6(*g*) is a silicon substrate 61 with a first minute conical solid structure 66". This structure is prepared starting with a silicon substrate 61 covered with an oxide layer 62 and a photoresist layer 63 patterned to a resist mask 64. A disc structure 65' is formed by etching under the mask 64 and then having its diameter reduced, resulting in a minute etching mask 65. A cylindrical structure 66' is formed by etching, without side-etching, under the minute etching mask 65 after removing of the resist etching mask 64. Then, the cylindrical structure 66' is side-etched to produce a first minute conical structure 66".

Next, as shown in FIG. 6(*h*), dry etching is applied under a no-side-etching condition to form a cylindrical second minute structure 66 under the conical minute structure 66", the diameter of the structure 66 being nearly the same as that of the minute etching mask 65.

Next, as shown in FIG. 6(*i*), by thermal oxidation the surfaces of the substrate 61, the side surfaces of the first minute solid structure 66" and the surface of the second minute solid structure 66 are changed to a silicon oxide layer 67, and at the same time a cathode (emitter) 70' of silicon in the shape of a minute tower with a sharp apex is formed within the structure.

Next, as shown in FIG. 6(*j*), wet etching is applied to remove the silicon oxide layer 67 thereby, exposing a cathode 70 with sharp apex.

Variations of the embodiments described above are possible. For example, instead of applying thermal oxidation to the surfaces, as is described under the Fourth, Fifth and Sixth Embodiments to form a cathode in the shape of a tower with a sharp apex, isotropic wet etching can also be used to form a similar sharp apex. Also, a similar result can be obtained by using thermal oxidation and isotropic wet etching in parallel.

Further, the cathode material is not confined to silicon as used in this embodiment. Any material that will produce an oxide thermal treatment and that can be removed by selective etching, can be used, as for example, tungsten. Also, instead of a silicon substrate, a substrate of a glass plate with a cathode (emitter) material, such as silicon deposited thereon, can also be used.

Seventh Embodiment

As shown in FIG. 7, a circular etching mask 102 of photoresist material is formed on a silicon substrate 101 by photolithography.

Next, as shown in FIG. 7(*b*), dry etching is applied onto the surface to produce under the mask 102 a cylindrical structure 104 with the wall 103 perpendicular to the surface of the substrate and the same diameter as the mask 102. The mask 102 is then removed.

Next, as shown in FIG. 7(*c*), by isotropic etching using, for example, a mixture of fluoric acid and nitric acid, a minute structure 105, with a reduced diameter, is formed.

Next, as shown in FIG. 7(*d*)-1, protective layers 106 are deposited on the top of the minute structure 105, as well as the top of the substrate 101. The side of the structure 105 is not covered with a protective layer.

Next, as shown in FIG. 7(*e*), thermal oxidation is applied to change the side of the structure 105 to a silicon oxide film 107 and to produce a minute silicon structure 108 with a sharp apex.

Next, as shown in FIG. 7(*f*), an insulating film 109, 109' and a metal film 110, 110' are deposited on the surfaces of the protective film 106.

Next, as shown in FIG. 7(*g*), the oxide film 107 around the silicon structure 108, the smaller protective layer 106, insulating film 109' and metal film 110' are removed by fluoric acid to expose a linear minute silicon cathode 111 with the metal film 110 becoming a gate electrode 110 having a small aperture around the apex of the cathode 111.

Variations of the process described as the Seventh Embodiment are possible. For example, after the formation of the protective layers 106 shown in FIG. 7(*d*)-1, it is possible to etch, with the protective layers 106 as masks, the side part of the minute structure 105 to reduce the diameter of the structure 105 and shorten the time for oxidation. This step is shown in FIG. 7(*d*)-2.

Further, instead of using silicon as the substrate, tantalum may be used and dry etching, isotropic etching, and thermal oxidation may be used to fabricate the cathode and the gate with a small aperture shown in FIG. 7(*g*).

The advantage in the process resides in the use of a protective layer instead of the minute etching mask to form a minute structure that is used to shape the cathode and small aperture of a gate of a field-emission element.

Eighth Embodiment

As shown in FIG. 8(*a*), over the (100) plane surface of a silicon substrate 121, an etching-protecting layer is deposited and, by photolithography, a circular etching mask 122 is prepared.

Next, as shown in FIG. 8(*b*), dry etching is applied to the surface of the substrate 121 to produce, under the mask 122, a first cylindrical structure 123 with the same diameter as mask 122 and with a wall perpendicular to the flat surface of the substrate 121.

Next, as shown in FIG. 8(*c*), by anisotropic etching the cylindrical structure, with the mask 122 still remaining on the top, a constricted part 124 is formed at the part of the structure 123 under the mask 122.

Next, as shown in FIG. 8(*d*), dry etching is again applied the downwards to etch the flat surface of the substrate 121 to result a second cylindrical structure 125 having longer cylindrical wall than the first cylindrical structure 123.

Next, as shown in FIG. 8(*e*), isotropic etching is applied to reduce the diameters of both the second cylindrical structure 123 and constricted part 124 to form a minute structure 125' having at its lower end, a minute cylindrical structure 129 and at its upper end an upper inverted minute conical structure 127, a lower minute conical structure 128 facing the upper conical structure 127, and a connecting part 126 in between the two conical structures.

Next, as shown in FIG. 8(*f*), by thermal oxidation of the top of the silicon substrate 121 and the surfaces of the structure 125', including the wall of the cylindrical structure 129 and the surfaces of the conical structures 126–128 are changed to an oxide layer 130. At the same time, the upper and lower conical structures 127, 128 are separated by the oxide layer 130, and the lower minute conical structure 128 is changed to a silicon cathode 131 with a sharp apex within the oxide layer 130.

Next, as shown in FIG. 8(*g*), an insulating film 132 and after a metal film 133, for use in a gate, are deposited around the minute cylindrical structure 129, employing the upper minute conical structure 127 as the mask. At the same time, an insulating film 132' and a metal film 133' are deposited on top of the minute conical structure 127.

Next, as shown in FIG. 8(*h*), by etching off the oxide layer 130, the upper minute conical structure together with insulation film 132' and the metal film 133' thereon are removed, resulting in the formation of a cathode 131 with a sharp apex, and a gate electrode 133 with a small aperture therearound.

The advantage of the process described as the Eighth Embodiment is the fabrication of a field-emission cathode, having a diameter of less than 100 nm, and a radius of curvature of less than 10 nm at the top.

The fabrication of a tower-type field-emission cathode having an extremely small diameter and a sharp apex for providing strong electric fields and operable at low voltages is possible due to the step shown in FIG. 8(*c*) wherein a constricted part 124 of small diameter is formed by anisotropic etching onto the side face of the structure 123.

Ninth Embodiment

The steps shown in FIGS. 9(*a*)–9(*c*) are the same steps shown in FIGS. 7(*a*)–7(*c*) and described under the Seventh Embodiment. In particular, a silicon substrate 141 having a minute cylindrical structure 144 (FIG. 9(*c*)) thereupon is fabricated by using the steps as shown in FIGS. 7(*a*)–7(*c*), with an etching mask 142, and a cylindrical structure 143.

Next, as shown in FIG. 9(*d*), by vacuum evaporation, a protective layer 145, for use as an etching mask, is placed on the top of the minute cylindrical structure 144 and the top surface of substrate 141.

Next, as shown in FIG. 9(*e*), anisotropic etching is applied to the side of the structure 144 to expose surfaces in the (111) plane, which is slanted from the top surface of the substrate 141, to form an upper minute conical structure 146, a lower minute conical structure 147, with the conical structures arranged in the vertical direction and opposing each other, and with a connecting part 152 in between. Then, thermal oxidation is applied, changing the surface of the minute conical structures to an oxide layer 148. At the same time, the minute conical structures 146, 147 are separated to form an upper minute conical structure 146 and lower minute conical structure 147.

Next, as shown in FIG. 9(*f*), using the upper minute conical structure 146 as a mask, an insulating layer 149 and after a metal layer 150, for use as a gate, are deposited on the top surface of the substrate 141. At the same time an insulating film 149' and then a metal layer 150' are deposited on the structure 146.

Next, as shown in FIG. 9(*g*), by etching the oxide layer 148, the upper minute conical structure 146, the insulating layer 149' and the metal film 150' are removed, exposing an emitter 151 with a sharp apex, and a gate electrode 150 with a very small aperture.

Thus, according to the process of the Ninth Embodiment, by etching a cylindrical structure 144 formed by a circular mask 145 isotropically and anisotropically, a full emission element having a cathode 151 with a sharp apex and a gate 150 with a very small aperture is fabricated. The advantage of the process is that it is possible to fabricate field-emission cathodes that have better characteristics than those possible before using known lithography techniques. It is not possible to fabricate a cathode with such a sharp apex and a gate electrode with such a small diameter using conventional lithograph techniques.

Variations of the process described as the Ninth Embodiment are possible. For example, if, after the anisotropic etching shown in FIG. 9(*d*), isotropic etching is applied, minute structures with a smoother connecting part can be obtained. Then, by thermal oxidation, a minute silicon structure with a sharper apex can be fabricated.

Further, instead of applying the isotropic etching in advance of the anisotropic etching, isotropic etching may be applied after the anisotropic etching to the side of the cylindrical structure.

Tenth Embodiment

Figure 10A:
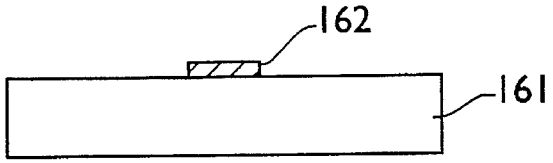
FIGS. 10(*a*), 10(*b*), 10(*c*), 10(*d*), 10(*e*) and 10(*f*) are sectional views of a field emission element fabricated according to the tenth embodiment of the invention isotropically-etching an anisotropically-etched structure.
Figure 10B:
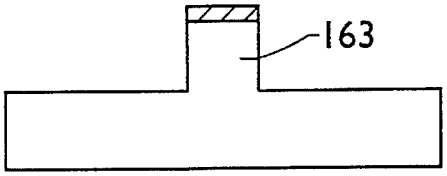
Figure 10C:
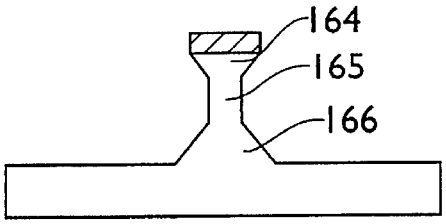
Figure 10D:
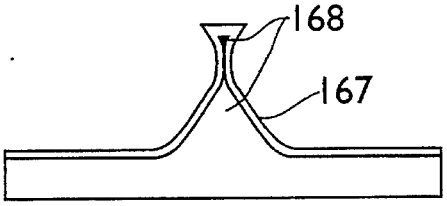
Figure 10E:
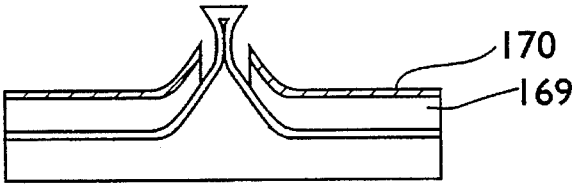
Figure 10F:
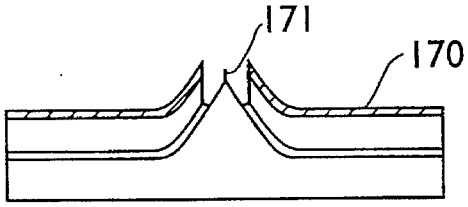

As shown in FIG. 10(*a*), a layer of silicon oxide or of silicon nitride is deposited on the (100) plane surface of a silicon substrate 161, doped with phosphorus. Then, a circular etching mask 162 is formed by using conventional photolithography.

Next, as shown in FIG. 10(*b*), dry etching is applied to etch off the surface of the substrate to form a cylindrical structure 163 on the substrate 161.

Next, as shown in FIG. 10(*c*), anisotropic etching with potassium hydroxide is applied to produce a couple of conical structures identified as an upper inverted conical structure 164 and a lower conical structure 166 with the side surface involving the (111) plane facing each other, and a cylindrical connecting part 165 having a small diameter and with its side surface involving the (100) plane.

Next, as shown in FIG. 10(*d*), the etching mask 162 is removed. Then, by isotropic etching, the transition portions, between the connecting part 165 and the conical structures 164, 166, are made smooth and the various cross-sections of the conical structures and the connecting part are reduced. Then, by thermal oxidation, a silicon oxide layer 167 is formed on the surfaces of the substrate 161, the conical structures 164, 166 and the connecting part 165, whereby, a couple of minute cathode structures 168 with sharp apexes are formed within the core of the connecting part 165. The shape of the apexes can be controlled by controlling the conditions of the etching and thermal oxidation steps.

Next, as shown in FIG. 10(*e*), by using the upper conical structure 164 as a mask, an insulating layer 169 and then a metal layer 170, to be used as a gate, are deposited on the substrate 161 and the top of the upper conical structure.

Next, as shown in FIG. 10(*f*), a fluoric hydride solution is applied to etch and remove the silicon oxide layer 167, the mask and insulating layer and metal film deposited thereon, and the upper portion of the conical structure 168, to expose an emitter 171 with a sharp apex and a gate electrode 170 therearound.

The advantage of the process described as the Tenth Embodiment is the fabrication of a field-emission element having a very sharp cathode and a gate with a very small aperture. Provided with leads, the field-emitting cathode is capable of being operated at lower voltage and producing layer current than the field-emitting cathode fabrication under conventional fabricating process using known lithography processes.

Thus, the process described under the Tenth Embodiment, that includes the forming of cylindrical structure 163 by a circular mask 162 prepared by lithography and the application of anisotropic etching will produce an electron source (field emission element) having a cathode with a sharp apex and a gate with an aperture smaller than elements producible using conventional lithography.

Eleventh Embodiment

The use of isotropic etching after the anisotropic etching in the Tenth Embodiment is not always necessary. A silicon minute structure with a sufficiently sharp apex can be fabricated provided appropriate conditions are satisfied as will be described hereinafter in the Eleventh Embodiment.

Figure 11A:
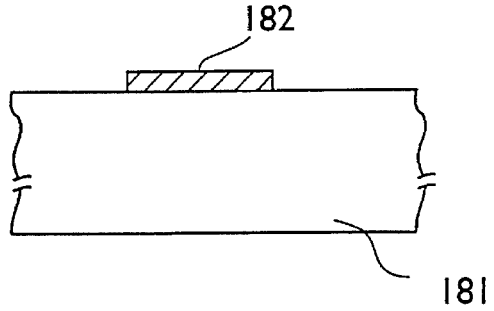
FIGS. 11(*a*), 11(*b*), 11(*c*), 11(*d*), and 11(*e*) are sectional views of a field emission element fabricated according to the eleventh embodiment of the invention applying thermal oxidation to a dry-etched structure.
Figure 11B:
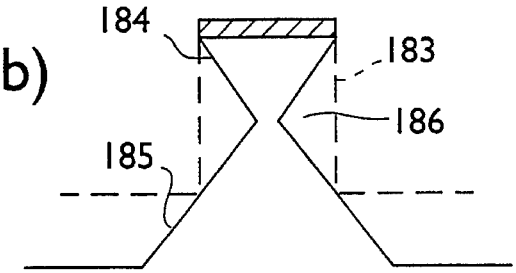
Figure 11C:
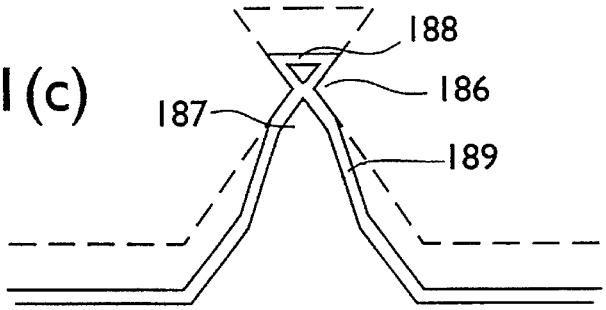
Figure 11D:
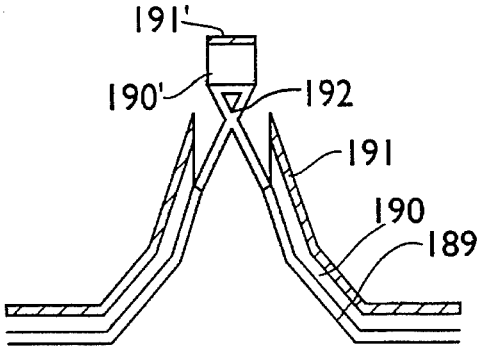
Figure 11E:
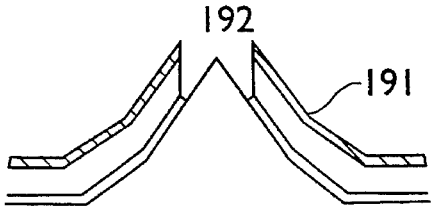

As shown in FIG. 11(*a*), a silicon oxide layer or silicon nitride layer is deposited on the (100) plane surface of a silicon substrate 181 doped with phosphorus. Then, a circular etching mask 182 is formed therefrom by a conventional photolithography process.

Next, as shown in FIG. 11(*b*), dry etching is applied to etch off the substrate 181 surface forming a cylindrical structure 183 (shown as dotted lines). Next, anisotropic etching with potassium hydroxide is applied to form, under the mask 182, an inverted upper conical structure 184, a lower conical structure 185, and a connecting part 186 in between the conical structures. The thickness of the connecting part 186 is quite easily controllable since the thickness is determined by the diameter of the circular mask 182 and the depth of the dry etching. Moreover, with enough anisotropic etching, the thickness of the connecting part is quite stable and independent of the outer condition.

Next, as shown in FIG. 11(*c*), the etching mask is removed and dry etching is again applied to etch the surface of the substrate 181, the lower conical structure, the upper conical structure 184, especially the part adjacent to the bottom (from the shape shown as dotted lines), and to reduce the size of the upper conical structure 184, producing an upper minute structure 188. Then, by thermal oxidation, an oxide layer 189 is applied to form a lower minute structure 187 with a sharp apex, whose radius of curvature is easily controllable by controlling the conditions of oxidation. The lower structure 187 is separated from the upper structure 188 by the oxidation step.

Next, as shown in FIG. 11(*d*), an insulating layer 190, 190' and after a metal layer 191, 181' are vacuum deposited, using the upper minute structure 188 as the mask.

By etching with hydrofluoric acid, the oxide layer 189 is removed and the upper structure 188, the insulating layer 190' and the metal layer 191' are lifted off, to form field-emitting element including a cathode 192 with sharp apex and a gate 191 with small aperture therearound (FIG. 11(*l*)).

Thus, according to the process of the Eleventh Embodiment, a cathode with sharp apex and a gate with an aperture, smaller than one obtainable by conventional lithography, can be fabricated by forming, with a circular mask 182 made by lithography, a cylindrical structure 183 and applying anisotropic etching thereto.

Twelfth Embodiment

The previous embodiments have shown the metal layer deposited on the surface of the substrate for use as a gate electrode. However, any other type of controlling electrode can be formed around the cathode. In addition, it is also possible to fabricate the field-emission cathode described herein as part of an integrated circuit.

Figure 12A:
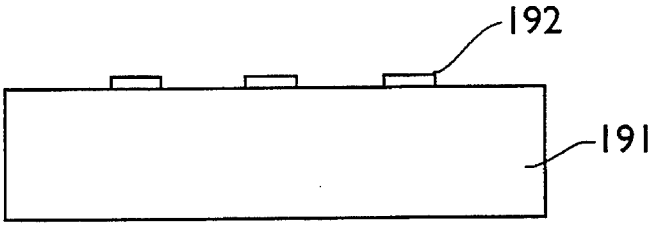
FIGS. 12(*a*), 12(*b*), 12(*c*), 12(*d*), 12(*e*) and 12(*f*) are sectional views of a plurality of field emission elements fabricated according to the twelfth embodiment of the invention applying thermal oxidation to an anisotropically-etched and dry-etched structure.
Figure 12B:
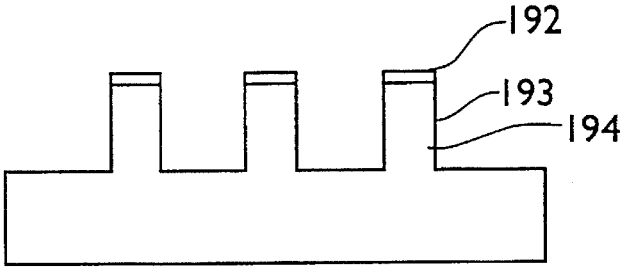
Figure 12C:
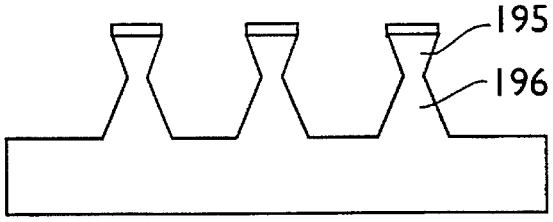
Figure 12D:
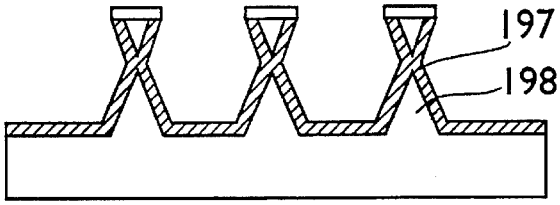
Figure 12E:
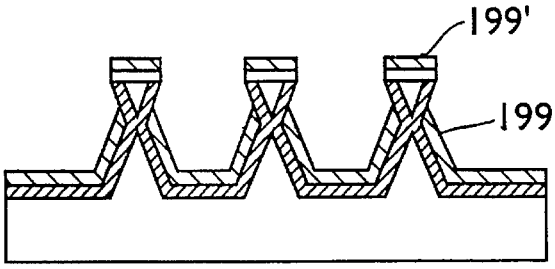
Figure 12F:
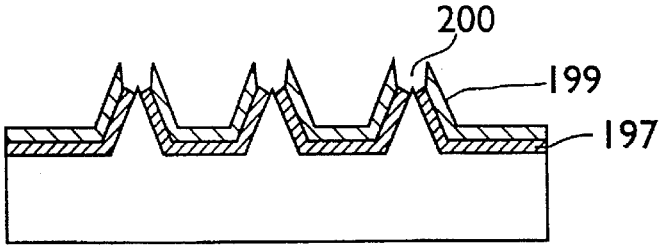
Figure 13A:
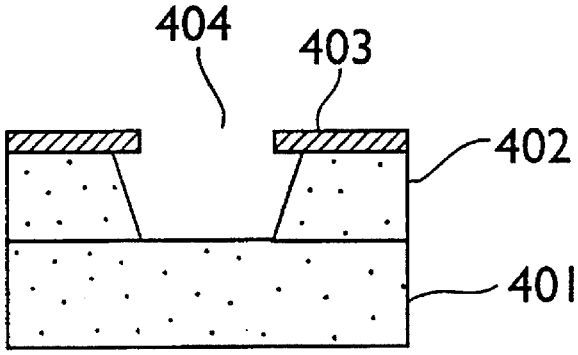
FIG.13(a) (PRIOR ART)
FIGS. 13(*a*), 13(*b*), 13(*c*) and 13(*d*) are sectional views of a field emission element fabricated according to a conventional photolithographic process.
Figure 13B:
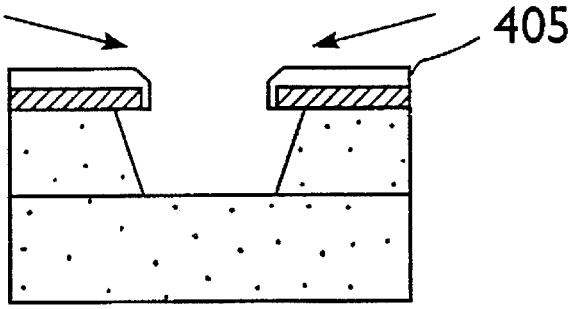
FIG.13(b) (PRIOR ART)
Figure 13C:
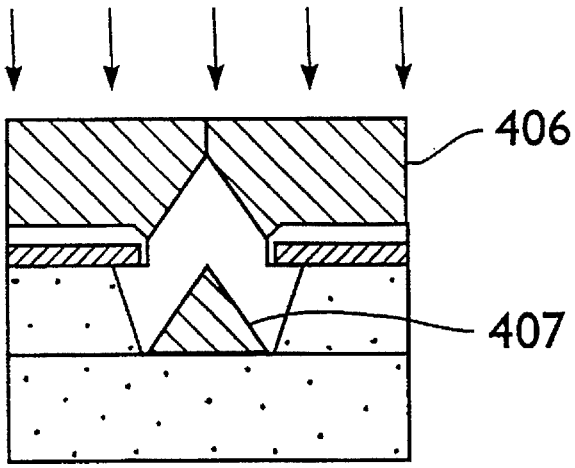
FIG.13(c) (PRIOR ART)
Figure 13D:
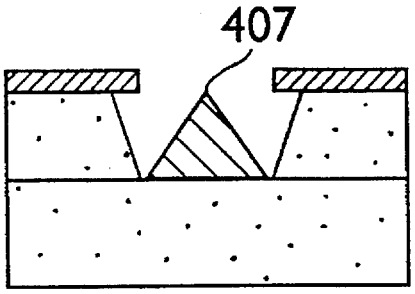
FIG.13(d) (PRIOR ART)
Figure 14A:
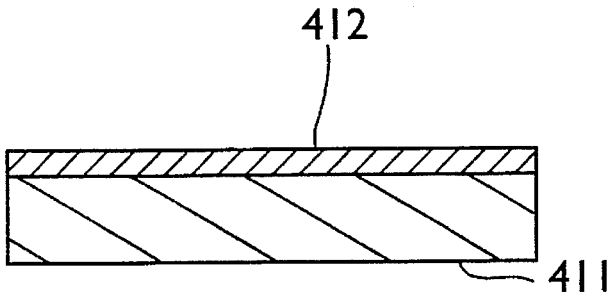
FIG.14(a) (PRIOR ART)
FIGS. 14(*a*) , 14(*b*) , 14(*c*) , 14(*d*) and 14(*e*) are sectional views of a field emission element fabricated according to a conventional photolithographic process including anisotropic etching.
Figure 14B:
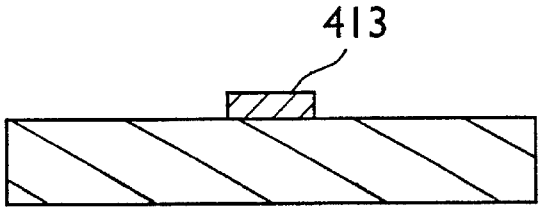
FIG.14(b) (PRIOR ART)
Figure 14C:
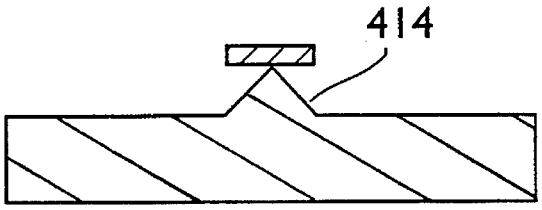
FIG.14(c) (PRIOR ART)
Figure 14D:
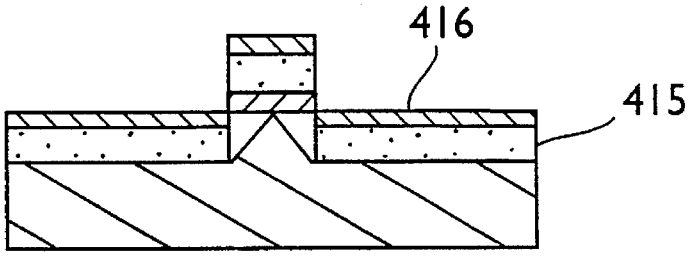
FIG.14(d) (PRIOR ART)
Figure 14E:
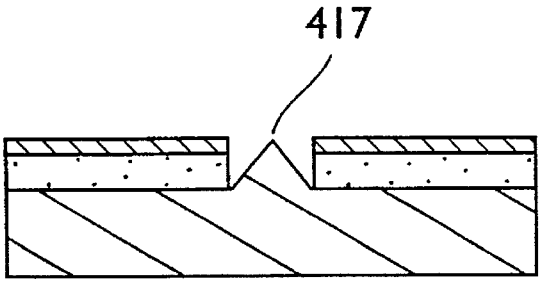
FIG.14(e) (PRIOR ART)
Figure 15A:
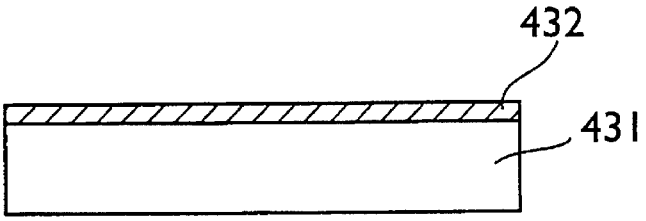
FIG. 15(a) (PRIOR ART)
FIGS. 15(*a*), 15(*b*), 15(*c*), 15(*d*) and 15(*e*) are sectional views of a field emission element fabricated according to a conventional photolithographic process including dry etching and thermal oxidation.
Figure 15B:
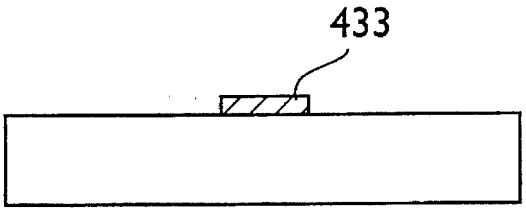
FIG. 15(b) (PRIOR ART)
Figure 15C:
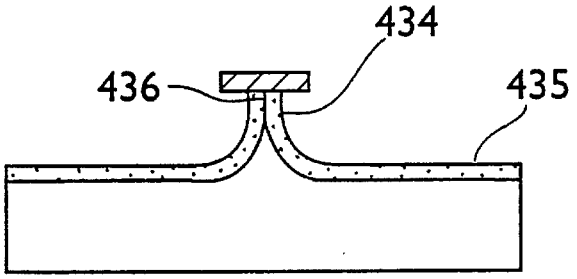
FIG. 15(c) (PRIOR ART)
Figure 15D:
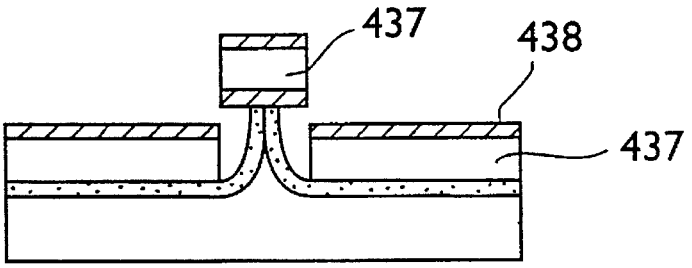
FIG. 15(d) (PRIOR ART)
Figure 15E:
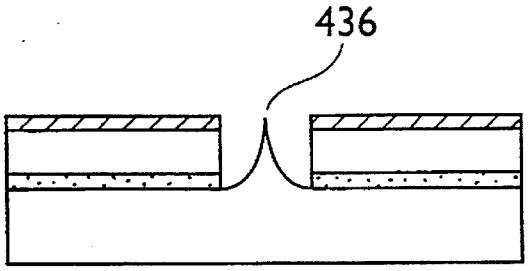
FIG. 15(e) (PRIOR ART)

As shown in FIG. 12(*a*), an etching-protecting film is deposited on the (100) plane surface of a silicon substrate 191, and then processed by photolithography to form circular etching masks 192.

Next, as shown in FIG. 12(*b*), dry etching is applied to the substrate to produce cylindrical structures 194, each having a diameter similar to the corresponding mask. Each of the cylindrical structures 194 are formed with a wall 193 perpendicular to the flat surface of the substrate 191.

Next, as shown in FIG. 12(*c*), by anisotropical etching the walls 193, the (111) plane surfaces are formed at an inclination of 57.4 degrees form the substrate surface. An upper conical structure 195 and a lower conical structure 196 are formed with the surfaces including (111) plane.

Next, as shown in FIG. 12(*d*), thermal oxidation is applied to oxidize the surfaces of the conical structures to produce an oxide layer 197 to separate the upper and the lower conical structures 195 and 196, and form a silicon cathode 198 with a sharp apex within the oxide layer 197.

Next, as shown in FIG. 12(*e*), vacuum deposition is applied in directions inclined differently from the substrate 191 surface to form, on the side surface of the lower conical structure 196, a metal layer 199 to be used as a gate and to form on top of the mask 192 a metal layer 199'.

Next, as shown in FIG. 12(*f*), the oxide layer 197 is selectively etched off to remove the upper structures 195 and the metal film 199' and to expose cathodes 20 with a sharp apex having a gate electrode 199 with a small aperture, with an oxide layer between the gate electrode 199 and the substrate 191.

Thus, according to the process described under the Twelfth Embodiment, it is possible to fabricate a field-emission cathode array with a plurality of cathodes each having a sharp apex and a gate with the diameter of its aperture being as small as the thickness of the silicon oxide layer.

Albeit the substrate disclosed above has been silicon, material such as GaAs can be substituted for the silicon substrate material.

It should be apparent the processes described above are highly advantageous for fabricating field-emission elements because the disclosed processes provide the elements with more desirable operating characteristics. Under conventional lithographic fabrication processes, the smallest gate aperture diameter available with good reproducibility is about 1 μm. With the above, described processes it is possible to fabricate field-emission element having gate electrodes much smaller. This enables the cathode to be operable at lower voltages and produce more electrons.

The processes described herein make it possible to fabricate tower type field-emission cathodes, rather than cone-shaped cathodes as produced by conventional methods. The results are stronger electron fields and operable at lower voltages. More importantly, the above-described processes make it possible to fabricate the aperture of gate electrodes with very small diameters thereby, making it possible to produce field emission elements with highly desirable operating characteristics. The diameter of the gate can be made smaller than the diameter of the etching mask. As a result, the processes disclosed herein can provide the cathode array with gate apertures less than 1 μm, even with conventional photolithography, resulting in the reduction of operating voltages and the increase of the current emissions.

The application of the methods of the present invention is not confined to that combined with the photolithography steps explained above. It is also possible to combine the steps disclosed herein with electron beam lithography or X-ray lithography.

The field-emission elements disclosed herein can be applied to various fields, including scanning type electron microscopes, electron-beam-excited lasers, planer type solid state display devices, minute vacuum devices etc.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of this invention.

What is claimed is:

1. A method of fabricating a minute field emitter comprising the steps of:

patterning a covering layer of a conductive substrate or a conductive layer formed on a substrate using an etching mask made by lithography, etching the patterned covering layer to form a minute etching mask from the covering layer that is smaller than said etching mask, etching the surface of the substrate or the conductive layer to form a pillar-shaped structure under said minute etching mask, etching the side surface of the pillar-shaped structure to form a minute structure with a thin part in the middle thereof, and etching the side surface of the minute structure to reduce the thin part to remove the upper part of the minute structure and to form a cathode with a sharp apex from the remaining lower part of the minute structure.

2. A method of fabricating a minute field-emitter according to claim 1 further comprising the step of depositing on an insulating layer and then a conductive layer on the substrate to form a gate.

3. A method of fabricating a minute field-emitter according to claim 2, further comprising the step of further etching the conductive substrate or the conductive layer to form, under the minute structure, a second minute pillar-shaped structure.

4. A method of fabricating a minute field-emitter according to claim 2, further comprising steps of:

oxidizing the surface of the minute structure with said thin part to form an oxide layer thereon, and wherein said etching step that removes said upper part also removes the oxidized surface.

5. A method of fabricating a minute field-emitter according to claim 1, wherein the step of patterning a covering layer using an etching mask is performed by dry etching and the step of etching for forming a minute etching mask is performed by wet etching, and further comprising the step of removing said etching mask after said minute etching mask is formed.

6. A method of fabricating a minute emitter according to claim 1, wherein the etching mask is photoresist material that dissolves when exposed to light.

7. A method of fabricating a minute emitter according to claim 1, wherein the covering layer is a layer of dielectric material and the etching mask is a layer of photoresist material.

8. A method of fabricating a minute field-emitter according to claim 1, wherein the etching mask is not soluble in a solution that dissolves the covering layer.

9. A method of fabricating a minute field-emitter according to claim 2, further comprising the steps of:

dry etching, with the minute etching mask, the substrate surface or the conductive layer to form, under the minute structure, a second minute structure having a cross-section similar to that of the minute etching mask, oxidizing the conductive substrate or the conductive layer surface, and the sides of the minute structure and the second minute structure, and wherein said etching step that removes said upper part also removes the oxide on the sides of the minute structure and second minute structure to remove the upper part of the minute structure together with the minute etching mask.

10. A method of fabricating a minute field-emitter according to claim 9, further comprising the step of oxidizing the surface of the minute structure with said thin part to form an oxide layer thereon before the step of forming the second minute structure.

11. A method of fabricating a minute field-emitter according to claim 1, wherein the surface of the substrate is the (100) plane of silicon, the step of etching to form the minute structure is anisotropic, and the side of the minute structure includes the (111) plane of silicon.

12. A method of fabricating a minute field-emitter according to claim 11, wherein the pattern of the etching mask is a dot with a certain diameter or a line with a certain width and arranged in <011> direction.

13. A method of fabricating a minute field-emitter comprising the steps of, forming an etching mask of circular or diagonal shape on a conductive substrate or a conductive layer, etching the part of the surface of the conductive substrate or the conductive layer not covered by the mask to form a pillar-shaped structure with the side perpendicular to the substrate surface, removing the etching mask and etching the surfaces of upper and side parts of the pillar-shaped structure to obtain a minute pillar-shaped structure having a diameter or a width which is smaller than the pillar-shaped structure, depositing a protection layer on the upper surface of the minute pillar-shaped structure and the substrate surface, forming an oxide layer on the side of the minute pillar-shaped structure, depositing around the minute pillar-shaped structure an insulator and then a conductor for a gate, using the protection layer formed on top of the minute pillar-shaped structure as a mask, and removing the protection layer and oxide layer to form a cathode having a minute cathode and a gate with a small aperture.

14. A method of fabricating a minute field-emitter according to claim 13, wherein an oxide layer is formed on the conductive substrate or the conductive layer surface by thermal oxidation, the step of etching to form the pillar-shaped structure is dry etching, and the step of etching to form the minute pillar-shaped structure is isotropic etching.

15. A method of fabricating a minute field-emitter according to claim 14, further comprising the step of etching of the side of the minute pillar-shaped structure after the step of depositing the protection layer.

16. A method of fabricating a minute field-emitter according to claim 13, wherein the substrate is of silicon.

17. A method of fabricating a minute field-emitter according to claim 13, wherein the substrate is of tantalum.

18. A method of fabricating a minute field-emitter according to claim 13, wherein the substrate is of silicon with a surface being in the (100) plane of silicon and following the step of etching to form the pillar-shaped structure, further comprising the steps of, anisotropically etching the side of the pillar-shaped structure employing the etching mask to reduce the cross-section of the pillar-shaped structure to form a constriction, etching again the surface of the conductive substrate or the conductive layer not covered by the etching mask to form a further pillar-shaped structure below the pillar-shaped structure with said constriction, and instead of depositing the protection layer, proceeding to the step of forming an oxide film on the surface of the conductive substrate or conductive layer as well as the side of the minute pillar-shaped structure.

19. A method of fabricating a minute field-emitter according to claim 13, wherein the conductive substrate is of (100) plane of silicon, and after the step of depositing of the protection layer, further comprising the steps of applying anisotropical etching to the side of the minute pillar-shaped structure perpendicular to the substrate to form an upper and a lower minute conical structure facing each other and connected at their respective tops.

20. A method of fabricating a minute field-emitter according to claim 19, wherein, after the step of etching to form the conical structure, further comprising the step of isotropically etching the conical structure for providing a smoother connecting portion.

21. A method of fabricating a minute field-emitter on a conductive substrate of silicon with a surface in the (100) plane of silicon comprising the steps of:

forming an etching mask of circular or polygonal shape on the surface, applying dry etching to the surface to form, under the etching mask, a pillar-shaped structure perpendicular to the surface, and applying anisotropical etching to form an upper inverted conical structure and a lower conical structure facing each other;

removing the etching mask, isotropical etching the surface of the conical structures to reduce the size thereof to form a minute upper structure and a lower minute structure, thermally oxidizing the minute structures to form a silicon oxide layer on the minute structures to separate the upper minute structure from the lower minute structure, depositing around the lower minute structure an insulator and then a conductor as a gate employing the upper minute structure as a mask, and etching off the oxide layer to remove the upper minute structure together with insulator and conductor thereon as well as the oxide covering the top of the lower minute structure to obtain a cathode with a sharp apex and a gate with a small aperture.

22. A method of fabricating a minute field-emitter according to claim 21, wherein the step of forming the conical structures further comprises the steps of providing, between the upper and lower structures, a pillar-shaped connecting part having its side perpendicular to the substrate surface.

23. A method of fabricating a minute field-emitter on a conductive substrate or a conductive layer comprising the steps of:

a structure forming process, which includes applying dry etching to the surface of the conductive surface or conductive layer to form, under an etching mask, a cylindrical structure perpendicular to the surface or layer, applying anisotropic etching to form a conical structure having an upper inverted structure and a lower structure facing each other;

thermally oxidizing the surface of the conical shaped structured to form a silicon oxide layer on the structures and separating the upper structure from the lower structure;

vacuum depositing in directions, slanted from the substrate surface to deposit on the surface of the lower structure covered with silicon oxide film a conducting material for a gate, and etching off the oxide layer to remove the upper structure together with the oxide layer near the top of the lower structure to form a minute cathode with a cathode having a sharp apex and a gate with a small aperture around the cathode.

24. A method of fabricating a minute field-emitter according to claim 23, wherein the step of depositing further comprises the step of depositing an insulator and a conductor for the gate on the surface of the lower structure having a silicon oxide surface.

25. A method of fabricating a field-emission element comprising:

a conductive substrate having a cathode with a sharp apex protruding from the conductive substrate, an insulating material covering the surface of the substrate and surrounding said cathode, and a conductive material covering the surface of the insulating material having an aperture with a width of less than 1 μm, wherein said aperture is produced including the steps of:

patterning a covering layer of said substrate using an etching mask made by lithography, and etching the patterned covering layer to form a minute etching mask of the covering layer that is smaller than said etching mask made by lithography.

26. A method of fabricating a field-emission element according to claim 25, wherein the shape of said aperture is circular or polygonal.

* * * * *